US009557694B2

(12) United States Patent
Suzuki

(10) Patent No.: US 9,557,694 B2
(45) Date of Patent: Jan. 31, 2017

(54) IMAGE FORMING APPARATUS HAVING A DEVELOPER CARRIER THAT SEPARATES FROM A PHOTOSENSITIVE MEMBER DURING SHEET RE-CONVEYANCE

(71) Applicant: BROTHER KOGYO KABUSHIKI KAISHA, Nagoya-shi, Aichi-ken (JP)

(72) Inventor: Yasuhiro Suzuki, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/664,455

(22) Filed: Mar. 20, 2015

(65) Prior Publication Data

US 2015/0277261 A1 Oct. 1, 2015

(30) Foreign Application Priority Data

Mar. 28, 2014 (JP) ..... 2014-070429

(51) Int. Cl.
*G03G 15/02* (2006.01)
*G03G 15/23* (2006.01)

(52) U.S. Cl.
CPC .... *G03G 15/234* (2013.01); *G03G 2215/0141* (2013.01); *G03G 2215/0193* (2013.01)

(58) Field of Classification Search
CPC ..... G03G 15/0136; G03G 2215/00371; G03G 2215/00679; G03G 2215/2083
See application file for complete search history.

(56) References Cited

U.S. PATENT DOCUMENTS

| | | | |
|---|---|---|---|
| 5,081,508 | A | 1/1992 | Kotani et al. |
| 5,455,603 | A | 10/1995 | Hori et al. |
| 6,389,243 | B2 | 5/2002 | Makino |
| 2002/0098013 | A1 | 7/2002 | Kamimura |

(Continued)

FOREIGN PATENT DOCUMENTS

| | | | |
|---|---|---|---|
| JP | 3620993 | B2 | 2/2005 |
| JP | 2014021194 | A | 2/2014 |

OTHER PUBLICATIONS

Office Action from U.S. Appl. No. 14/664,412, mailed Aug. 24, 2015, 23 pages.

(Continued)

*Primary Examiner* — Minh Phan
*Assistant Examiner* — Victor Verbitsky
(74) *Attorney, Agent, or Firm* — Merchant & Gould P.C.

(57) ABSTRACT

An image forming apparatus includes: an image forming unit including first and second photosensitive members, and first and second developer carriers; a re-conveyance mechanism configured to convey a recording sheet discharged from the image forming unit towards the image forming unit; a separation/stop mechanism configured to switch a developing unit between an image formation mode in which the first developer carrier contacts the first photosensitive member and a separation mode in which the first developer carrier is separated from the first photosensitive member and the second developer carrier is separated from the second photosensitive member, and a control device configured to switch the developing unit from the image formation mode to the separation mode while the re-conveyance mechanism conveys a first recording sheet after the image forming unit forms an image on a first surface of the first recording sheet.

22 Claims, 12 Drawing Sheets

(56) References Cited

U.S. PATENT DOCUMENTS

| | | | | |
|---|---|---|---|---|
| 2003/0129009 | A1 | 7/2003 | Matsuyama et al. | |
| 2003/0170048 | A1 | 9/2003 | Ahn | |
| 2004/0052547 | A1 | 3/2004 | Matsuura et al. | |
| 2008/0118274 | A1 | 5/2008 | Ahn et al. | |
| 2009/0035041 | A1 | 2/2009 | Yang | |
| 2009/0060568 | A1 | 3/2009 | Ishikawa et al. | |
| 2009/0180808 | A1 | 7/2009 | Hyun-Ho | |
| 2010/0150633 | A1 | 6/2010 | Tanaka | |
| 2011/0176832 | A1 | 7/2011 | Mase | |
| 2011/0188061 | A1 | 8/2011 | Miyamoto | |
| 2011/0211003 | A1 | 9/2011 | Kusakabe | |
| 2011/0318078 | A1 | 12/2011 | Aoi | |
| 2013/0168921 | A1 | 7/2013 | Suzuki et al. | |
| 2013/0209121 | A1 | 8/2013 | Uchitani et al. | |
| 2013/0209131 | A1 | 8/2013 | Uchitani et al. | |
| 2014/0016957 | A1* | 1/2014 | Suzuki ..... | G03G 15/2014 399/67 |
| 2014/0016979 | A1 | 1/2014 | Suzuki et al. | |
| 2014/0020489 | A1 | 1/2014 | Nozaki et al. | |

OTHER PUBLICATIONS

Office Action from U.S. Appl. No. 14/700,800, mailed Dec. 21, 2015, 27 pages.
Final Office Action from U.S. Appl. No. 14/700,800, mailed Jul. 27, 2016, 24 pages.

* cited by examiner

IMAGE FORMING APPARATUS HAVING A DEVELOPER CARRIER THAT SEPARATES FROM A PHOTOSENSITIVE MEMBER DURING SHEET RE-CONVEYANCE

CROSS REFERENCE TO RELATED APPLICATION

This application is based upon and claims the benefit of priority of Japanese Patent Application No. 2014-070429 filed on Mar. 28, 2014, the contents of which are incorporated herein by reference in its entirety.

BACKGROUND

The present disclosure relates to an image forming apparatus capable of performing a duplex printing.

In the related art, an image forming apparatus such as a printer capable of performing a duplex printing has been known. The image forming apparatus is configured to discharge a sheet of which a surface has been formed with an image from an image forming unit, to reverse the surface and a backside of the sheet and then to re-convey the sheet to the image forming unit.

In the image forming apparatus of the related art, since a developing device is operating while the recording sheet is re-conveyed, there is a possibility that a mechanical configuration of the developing device and developer in the developing device may be deteriorated.

SUMMARY

It is therefore an object of an aspect of the present disclosure to provide an image forming apparatus capable of prolonging a lifetime of a developing device.

The aspect of the present disclosure provides the following arrangements;

An image forming apparatus comprising:

an image forming unit including a first photosensitive member, a second photosensitive member, a rotatable first developer carrier and a rotatable second developer carrier;

a re-conveyance mechanism configured to convey a recording sheet discharged from the image forming unit towards the image forming unit;

a separation/stop mechanism configured to switch a developing unit between an image formation mode in which at least the first developer carrier contacts the first photosensitive member and a separation mode in which the first developer carrier is separated from the first photosensitive member and rotation of the first developer carrier is stopped and the second developer carrier is separated from the second photosensitive member and rotation of the second developer carrier is stopped, and a control device configured to switch the developing unit from the image formation mode to the separation mode while the re-conveyance mechanism conveys a first recording sheet after the image forming unit forms an image on a first surface of the first recording sheet.

An image forming apparatus comprising:

a photosensitive member;

a rotatable developer carrier;

a transfer member configured to transfer a developer image on a recording sheet at a transfer position;

a feeder mechanism defining a sheet feeding path for feeding the recording sheet to the transfer position, the feeder mechanism including a supply roller arranged on the sheet feeding path;

a re-conveyance mechanism defining a re-conveyance path for re-conveying the recording sheet having passed through the transfer position to the transfer position again, the re-conveyance mechanism including a re-conveyance roller arranged on the re-conveyance path;

a cam configured to separate the developer carrier from the photosensitive member, and a control device configured to drive the cam while the re-conveyance roller conveys the recording sheet.

An image forming apparatus comprising:

a photosensitive member;

a rotatable developer carrier;

a transfer member configured to transfer a developer image on a recording sheet at a transfer position;

a feeder mechanism defining a sheet feeding path for feeding the recording sheet to the transfer position, the feeder mechanism including a supply roller arranged on the sheet feeding path;

a re-conveyance mechanism defining a re-conveyance path for re-conveying the recording sheet having passed through the transfer position to the transfer position again, the re-conveyance mechanism including a re-conveyance roller arranged on the re-conveyance path;

a cam configured to separate the developer carrier from the photosensitive member;

a housing configured to accommodate the photosensitive member;

a discharge tray provided at an outer side of the housing and configured to support the recording sheet discharged to an outside of the housing;

a switchback roller configured to rotate in a forward direction to convey the recording sheet having passed through the transfer position in a direction coming close to the discharge tray and configured to rotate in a reverse direction opposite to the forward direction, and a control device configured to drive the cam while the recording sheet is present on the re-conveyance path.

BRIEF DESCRIPTION OF DRAWINGS

FIGS. 3A to 3C illustrate a developing device separation/stop mechanism, in which FIG. 3A illustrates a color mode, FIG. 3B illustrates a monochrome mode and FIG. 3C illustrates a separation mode.

FIG. 7 is a timing chart showing operations of a developing device, a photosensitive member and a belt in the first aspect, in which FIG. 7A shows the printing speed priority mode and FIG. 7B shows the lifetime priority mode.

FIG. 12 is a timing chart showing operations of the developing device, the photosensitive member and the belt in the second aspect, in which FIG. 12A shows the printing speed priority mode and FIG. 12B shows the lifetime priority mode.

DESCRIPTION OF ILLUSTRATIVE EMBODIMENTS

Figure 1:
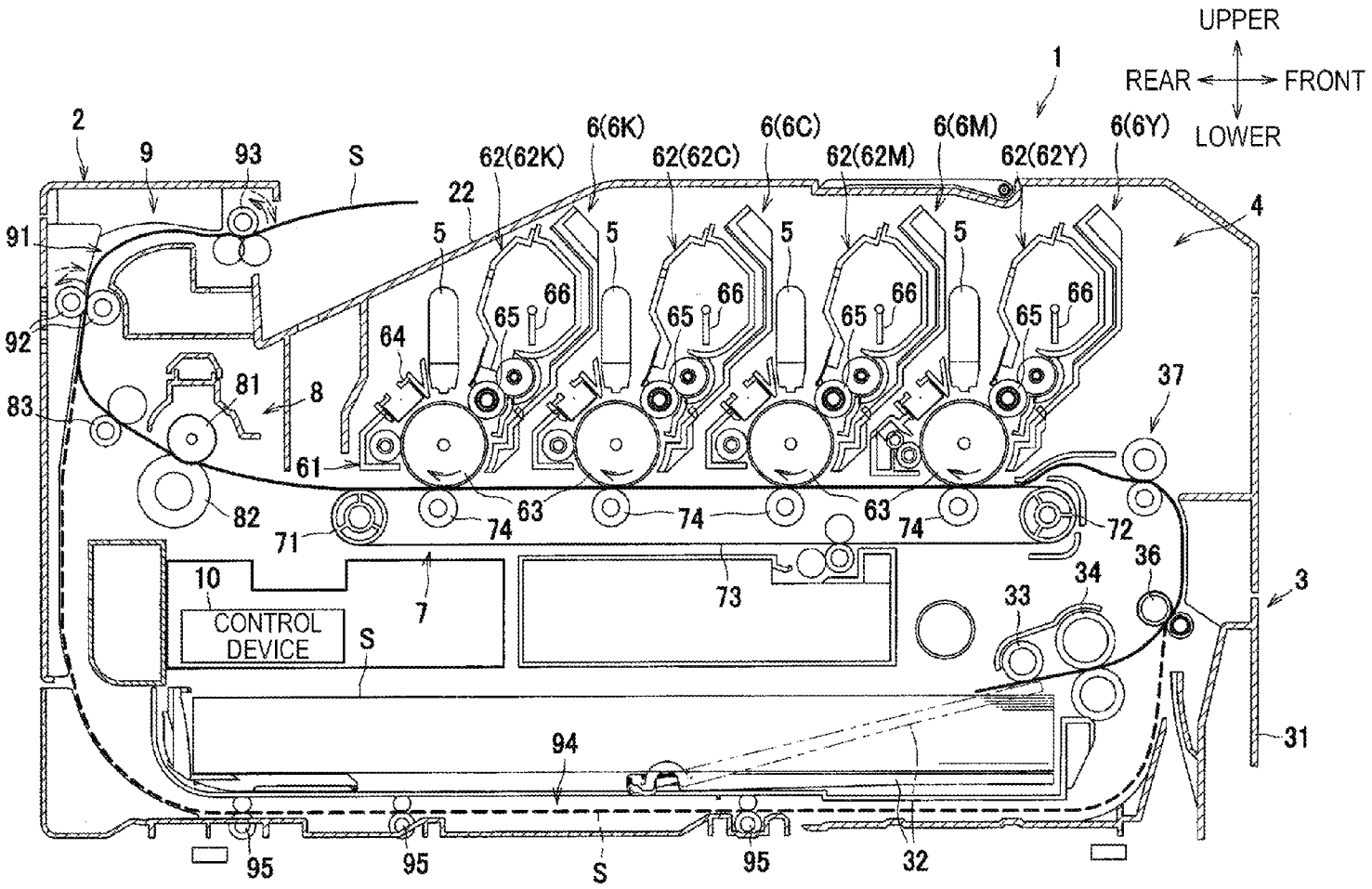
FIG. 1 illustrates a schematic configuration of a color printer, which is an example of the image forming apparatus according to an illustrative embodiment.

Hereinafter, an illustrative embodiment of the present disclosure will be described in detail with reference to the drawings. Meanwhile, in below descriptions, directions are described on the basis of a user who uses a color printer 1, which is an example of the image forming apparatus. Specifically, a right side of FIG. 1 is referred to as a 'front', a left side of FIG. 1 is referred to as a 'rear', a front side of FIG. 1 is referred to as 'left' and an inner side of FIG. 1 is referred to as 'right'. Also, an upper-lower direction of FIG. 1 is referred to as 'upper and lower'.

<Schematic Configuration of Color Printer>

As shown in FIG. 1, the color printer 1 is configured to form images on both surfaces of a sheet S, which is an example of the recording sheet, and mainly has a feeder unit 3, an image forming unit 4 and a conveyance unit 9 in a main body housing 2. The main body housing 2 is provided on its upper surface with a sheet discharge tray 22 on which the sheet S discharged from an inside of the main body housing 2 is placed.

The feeder unit 3 is provided at a lower part in the main body housing 2, and mainly has a sheet feeding tray 31 configured to accommodate therein sheets S, a sheet pressing plate 32, a feeder roller 33, separation rollers 34, conveyance rollers 36, and register rollers 37.

When feeding the sheets S in the sheet feeding tray 31 towards the image forming unit 4, the sheets S in the sheet feeding tray 31 are inclined towards the feeder roller 33 by the sheet pressing plate 32. Then, the sheets S are delivered towards the separation rollers 34 by the feeder roller 33, are separated one by one by the separation rollers 34, and are then fed towards the image forming unit 4 by the conveyance rollers 36 and the register rollers 37.

The image forming unit 4 has four LED units 5, four process units 6, a transfer unit 7, and a fixing device 8.

The LED unit 5 is arranged above a photosensitive drum 63, and has a plurality of LEDs (Light Emitting Diodes) (not shown) at a lower end thereof, which are arranged in a left-right direction. The LEDs are blinked, based on image data, so that the LED unit 5 exposes a surface of the photosensitive drum 63.

The process units 6 are arranged side by side in a front-rear direction between the sheet discharge tray 22 and the sheet feeding tray 31, and have a drum cartridge 61 and a developing cartridge 62, which is an example of the developing device configured to be detachably mounted to the drum cartridge 61, respectively. Each drum cartridge 61 has the photosensitive drum 63, a charger 64, and the like. Each developing cartridge 62 has a developing roller 65, a toner accommodation part configured to accommodate therein toner that is an example of the developer, an agitator 66 configured to stir the toner in the toner accommodation part, and a toner supply roller, a layer thickness regulation blade and the like whose reference numerals are omitted.

The process units 6 are configured so that the process units 6K, 6C, 6M, 6Y, in which toners of respective colors of black, cyan, magenta and yellow are accommodated, are arranged side by side from the rear side in corresponding order. Hereinafter, in the specification and drawings, when specifying the photosensitive drums 63, the developing rollers 65 and the like corresponding to the toner colors, the reference numerals K, C, M and Y are attached in correspondence to black, cyan, magenta and yellow, respectively.

The transfer unit 7 is provided between the sheet feeding tray 31 and the process units 6, and mainly has a driving roller 71, a driven roller 72, a conveyance belt 73, and four transfer rollers 74. The conveyance belt 73 extends with being tensioned between the driving roller 71 and the driven roller 72 and has an outer surface arranged to face the four arranged photosensitive drums 63. At an inner side of the conveyance belt 73, the transfer rollers 74 are arranged to sandwich the conveyance belt 73 between the transfer rollers 74 and the corresponding photosensitive drums 63.

In the image forming unit 4, the surface of the photosensitive drum 63 being rotated is uniformly charged by the charger 64 and is then exposed by the LED unit 5, so that an electrostatic latent image based on the image data is formed on the photosensitive drum 63. Also, the toner in the toner accommodation part is supplied to the developing roller 65 through the toner supply roller, is introduced between the developing roller 65 and the layer thickness regulation blade, and is then carried on the developing roller 65, as a thin layer having a predetermined thickness.

The toner carried on the developing roller 65 is supplied to the electrostatic latent image formed on the photosensitive drum 63 when the developing roller 65 contacts the photosensitive drum 63. Thereby, the electrostatic latent image becomes visible and a toner image is thus formed on the photosensitive drum 63, as a developer image. After that, the sheet S fed to the image forming unit 4 is conveyed between the photosensitive drum 63 and the conveyance belt 73, so that the toner image on the photosensitive drum 63 is transferred to the sheet S.

The fixing device 8 is provided at the rear of the image forming unit 4, and mainly has a heating roller 81 and a pressing roller 82 arranged to face the heating roller 81 and configured to press the heating roller 81. In the fixing device 8, the sheet S having the toner images transferred thereto is conveyed between the heating roller 81 and the pressing roller 82, so that the toner images are heat-fixed and an image is thus formed on the sheet S. The sheet S having the toner images heat-fixed thereon is carried out of the fixing device 8 to a conveyance path 91 by carrying-out rollers 83.

The conveyance unit 9 is configured to convey the sheet S, which is carried out of the image forming unit 4, towards an outside of the main body housing 2 or again towards the image forming unit 4, and mainly has the conveyance path 91, conveyance rollers 92, discharge rollers 93, a re-conveyance path 94, and a plurality of re-conveyance rollers 95, which is an example of the re-conveyance mechanism provided on the re-conveyance path 94.

The conveyance path 91 extends upwardly from the vicinity of the carrying-out rollers 83 and is then curved forwards. Also, the re-conveyance path 94 extends downwardly from the vicinity of the rear of the carrying-out rollers 83, is curved forwards, extends forwards along the lower of the sheet feeding tray 31, is curved upwardly and then extends towards the conveyance rollers 36.

The conveyance rollers 92 and the discharge rollers 93 are respectively configured to switch a rotating direction thereof between a forward conveying direction, which is a direction along which the sheet S is conveyed towards the outside of the main body housing 2, and a reverse conveying direction, which is a direction along which the sheet S sandwiched therebetween is conveyed towards the re-conveyance path 94.

In the conveyance unit 9, when forming an image on only one surface (first surface) of the sheet S, the sheet S carried out of the image forming unit 4 is discharged to the outside of the main body housing 2 by the conveyance rollers 92 and discharge rollers 93 being rotated in the forward direction and is then placed on the sheet discharge tray 22. On the other hand, when forming images on both surfaces of the sheet S, the conveyance rollers 92 and the discharge rollers 93 are rotated in the reverse direction at timing before a rear end of the sheet S comes out between the conveyance rollers 92, so that the sheet S having the toner images heat-fixed on one surface thereof is guided to the re-conveyance path 94. Then, the sheet S (refer to the broken line) of which surface and backside are reversed is conveyed through the re-conveyance path 94 by the re-conveyance rollers 95, and is again guided to the image forming unit 4 by the conveyance rollers 36 and the register rollers 37. The sheet S of which the other surface (second surface) has been formed with an image in the image forming unit 4 is carried out of the image forming unit 4, is discharged to the outside of the main body housing 2 by the conveyance rollers 92 and discharge rollers 93 being rotated in the forward conveying direction and is then placed on the sheet discharge tray 22. In the meantime, the conveying timing by the conveyance unit 9 and the feeding timing by the feeder unit 3 are implemented in various aspects, and some examples thereof will be described later.

<Configuration of Driving Transmission Mechanism of Color Printer>

Subsequently, a configuration of a driving transmission mechanism of the color printer 1 is described.

Figure 2:
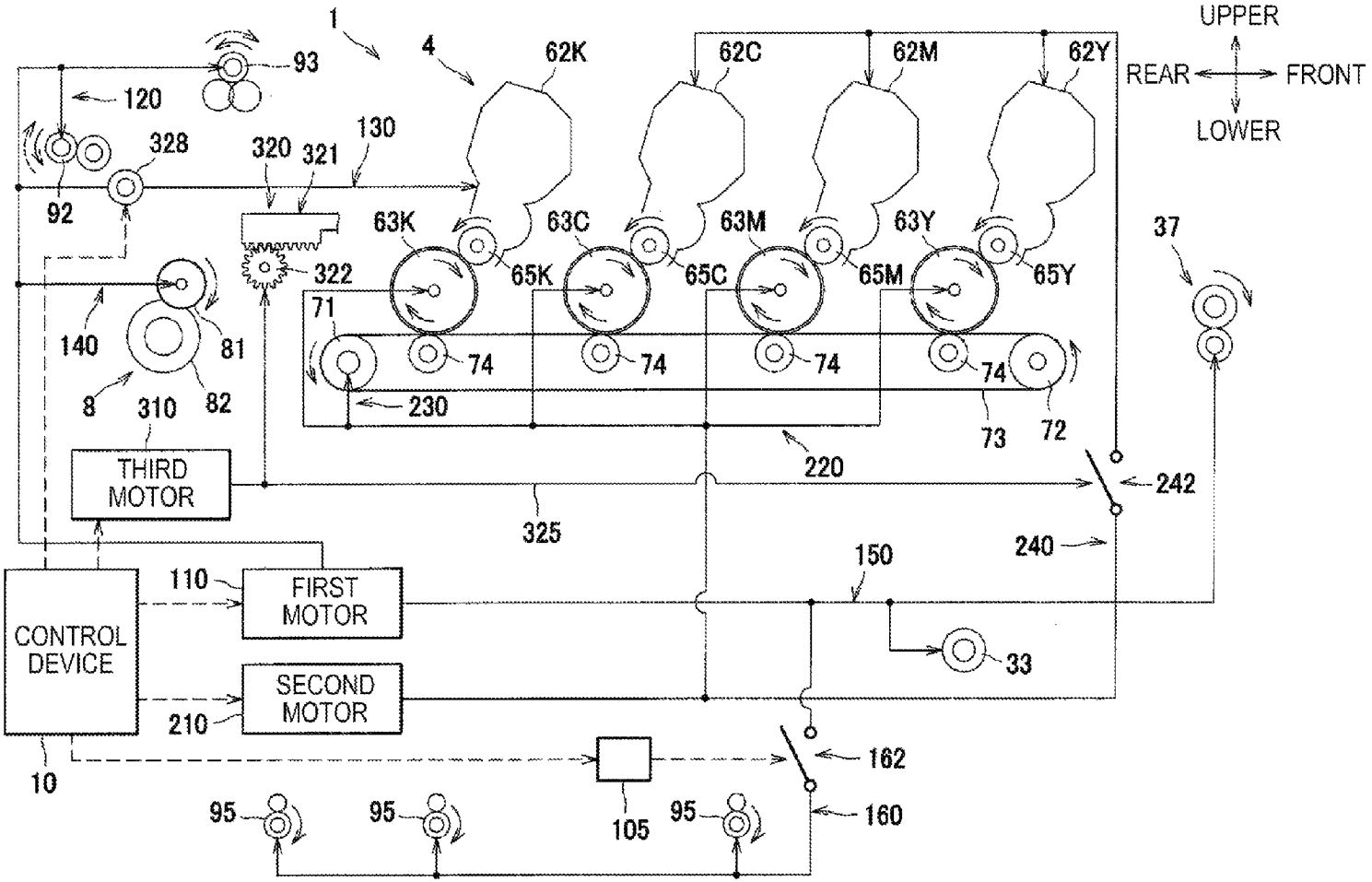
FIG. 2 is a pictorial view illustrating a mechanism configured to control respective units of the color printer.

As shown in FIG. 2, the color printer 1 has a first motor 110 serving as the first driving source, a second motor 210 serving as the second driving source, a third motor 310 serving as the third driving source, a conveyance driving transmission mechanism 120, a first developing driving transmission mechanism 130, a fixing driving transmission mechanism 140, a supply driving transmission mechanism 150, a re-conveyance driving transmission mechanism 160, a photosensitive member driving transmission mechanism 220, a belt driving transmission mechanism 230, a second developing driving transmission mechanism 240 and a developing device separation/stop mechanism 320.

The first motor 110 is a motor configured to drive members of a conveyance system of the sheet S mainly including the sheet feeding and the sheet discharge and the black developing cartridge 62K, which is an example of the first developing device. Specifically, the first motor 110 is a motor for applying a driving force to the developing roller 65K, the conveyance rollers 92, the discharge rollers 93, the fixing device 8, the feeder roller 33, the register rollers 37 and the re-conveyance rollers 95, and is configured to rotate only in one direction. The first motor 110 is driven by a control device 10 when a printing job is received. The first motor 110 is configured to apply a driving force to the carrying-out rollers 83.

The second motor 210 is a motor configured to drive members for forming and transferring toner images on the sheet S. Specifically, the second motor 210 is a motor for applying the driving force to the developing rollers 65C, 65M, 65Y of the developing cartridges 62C, 62M, 62Y corresponding to cyan, magenta and yellow different from black, which are examples of the second developing device, the four photosensitive drums 63 and the conveyance belt 73, and is configured to rotate only in one direction. The driving and stopping of the second motor 210 are controlled by the control device 10, in correspondence to a conveyance pattern of the sheet S. Meanwhile, in the specification, the four developing cartridges 62K, 62C, 62M, 62Y are collectively referred to as 'developing unit' for convenience sake.

The third motor 310 is a motor configured to generate a driving force for selectively separating each developing roller 65 of the developing cartridges 62 from the photosensitive drum 63. The third motor 310 is configured to be rotatable in the forward and reverse directions, and the rotating direction, driving and stopping thereof are controlled by the control device 10.

The conveyance driving transmission mechanism 120 is a gear train configured to transmit the driving force of the first motor 110 to the conveyance rollers 92 and discharge rollers 93. The conveyance driving transmission mechanism 120 is provided with a moveable gear (not shown), and is configured to move the moveable gear by a solenoid actuator (not shown) to thus change a number of idle gears to be coupled, thereby switching the rotating directions of the conveyance rollers 92 and discharge rollers 93 between the forward direction and the reverse direction. In the meantime, the solenoid actuator is controlled at appropriate timing by the control device 10.

The first developing driving transmission mechanism 130 is a gear train configured to transmit the driving force of the first motor 110 to the black developing cartridge 62K. The first developing driving transmission mechanism 130 is provided with an electromagnetic clutch 328, which is a part of the developing device separation/stop mechanism 320, and the control device 10 turns on or off the electromagnetic clutch 328, so that the driving and stopping of the developing cartridge 62K including the developing roller 65K and the agitator 66 are controlled.

The fixing driving transmission mechanism 140 is a gear train configured to transmit the driving force of the first motor 110 to the fixing device 8. While the first motor 110 is operating, the fixing device 8 can always convey the sheet S in a predetermined direction.

The supply driving transmission mechanism 150 is a gear train configured to transmit the driving force of the first motor 110 to the feeder roller 33 and register rollers 37. While the first motor 110 is operating, the register rollers 37 are rotated all the time in a predetermined direction. Also, the feeder roller 33 is configured to rotate only at feeding timing by an actuator (not shown), which is controlled by the control device 10, thereby picking up the sheet S on the sheet feeding tray 31.

The re-conveyance driving transmission mechanism 160 is a gear train configured to transmit the driving force of the first motor 110 to the re-conveyance rollers 95. The re-conveyance driving transmission mechanism 160 has a moveable gear 162, which is an example of the stop mechanism, and is configured to move the moveable gear 162 by a solenoid actuator 105, which is controlled by the control device 10, thereby switching the driving and stopping of the re-conveyance rollers 95.

The photosensitive member driving transmission mechanism 220 is a gear train configured to transmit the driving force of the second motor 210 to the four photosensitive drums 63. While the second motor 210 is operating, the photosensitive drum 63 is always rotated in a predetermined direction, and is stopped when the second motor 210 is stopped by the control device 10.

The belt driving transmission mechanism 230 is a gear train branched from the photosensitive member driving transmission mechanism 220 and is arranged to transmit the driving force of the second motor 210 to the driving roller 71. While the second motor 210 is operating, the conveyance belt 73 is always rotated in a predetermined direction, and is stopped when the second motor 210 is stopped by the control device 10.

The second developing driving transmission mechanism 240 is a gear train configured to transmit the driving force of the second motor 210 to the developing cartridges 62C, 62M, 62Y corresponding to cyan, magenta and yellow. The second developing driving transmission mechanism 240 has a moveable gear 242 and is configured to move the moveable gear 242 by a link 325 (which will be described later), so that the gear train of the second developing driving transmission mechanism 240 can be connected or disconnected and the driving and stopping of the developing cartridges 62C, 62M, 62Y can be thereby switched.

The developing device separation/stop mechanism 320 is a mechanism configured to switch the developing unit between an image formation mode in which at least the developing cartridge 62K contacts the black photosensitive drum 63K, which is an example of the first photosensitive member, and a separation mode in which the black developing cartridge 62K is spaced and is stopped from the black photosensitive drum 63K and the developing cartridges 62C, 62M, 62Y except for the black developing cartridge 62K are spaced and are stopped from the photosensitive drums 63C, 63M, 63Y except for the black photosensitive drum 63K, which are examples of the second photosensitive member. Here, the image formation mode includes a color mode, which is an example of the multi-color mode in which the black developing cartridge 62K contacts the black photosensitive drum 63K and the developing cartridges 62C, 62M, 62Y except for the black developing cartridge 62K contact the photosensitive drums 63C, 63M, 63Y except for the black photosensitive drum 63K, and a monochrome mode, which is an example of the single color mode in which the black developing cartridge 62K contacts the photosensitive drum 63K and the developing cartridges 62C, 62M, 62Y except for the black developing cartridge 62K are spaced and are stopped from the photosensitive drums 63C, 63M, 63Y except for the black photosensitive drum 63K.

In order to implement the above functions, the developing device separation/stop mechanism 320 has a developing device actuator 321, a switching gear 322 configured to drive in the forward and reverse directions by the third motor, and a link 325 configured to operate in conjunction with an operation of the switching gear 322.

Figures 3A, 3B, 3C:
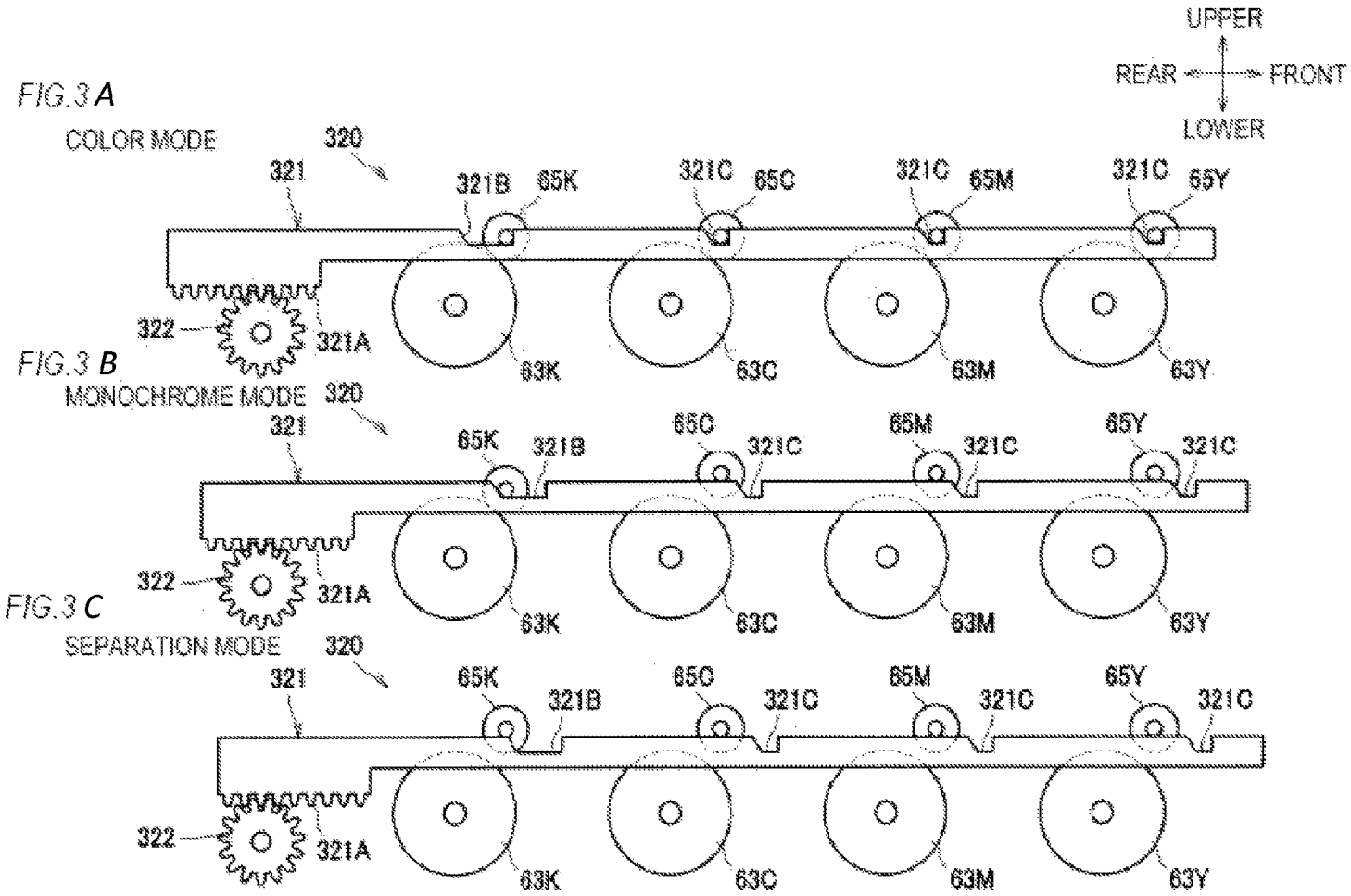

Specifically, as shown in FIG. 3A, the developing device actuator 321 has a rod shape, which is long along the arranging direction of the developing rollers 65K, 65C, 65M, 65Y, and is provided at a rear end portion thereof with a rack gear 321A. The rack gear 321A is meshed with the switching gear 322, and is configured to change a position thereof in the front-rear direction by rotation of the switching gear 322 in the forward or reverse direction, as shown in FIGS. 3A to 3C. Also, the developing device actuator 321 has a recess portion 321B to which a shaft of the black developing roller 65K can be engaged, and three recess portions 321C to which shafts of the cyan, magenta and yellow developing rollers 65C, 65M, 65Y can be respectively engaged. Each of the recess portions 321B, 321C is formed at its rear end portion with an inclined surface configured to be higher as it faces rearwards. Also, the recess portion 321B is formed to be longer than the recess portions 321C in the front-rear direction.

As shown in FIG. 3A, in the color mode, the four developing rollers 65K, 65C, 65M, 65Y are engaged with front end portions of the recess portions 321B, 321C, the developing roller 65K contacts the photosensitive drum 63K, and the developing rollers 65C, 65M, 65Y contact the photosensitive drums 63C, 63M, 63Y, respectively. In the color mode, the moveable gear 242 is configured to connect the gear train of the second developing driving transmission mechanism 240 by the operation of the link 325.

As shown in FIG. 3B, when the switching gear 322 is slightly rotated in a clockwise direction from the color mode, the developing device actuator 321 is slightly moved forwards. Since the black developing roller 65K is positioned in the recess portion 321B, the black developing roller 65K is kept with contacting the photosensitive drum 63K. However, the shafts of the developing rollers 65C, 65M, 65Y except for the black developing roller 65K ride on the inclined surfaces of the recess portions 321C and are thus spaced from the photosensitive drums 63C, 63M, 63Y. That is, the monochrome mode is set. In the monochrome mode, the moveable gear 242 is configured to disconnect the gear train of the second developing driving transmission mechanism 240 by the operation of the link 325.

As shown in FIG. 3C, when the switching gear 322 is further rotated in the clockwise direction from the monochrome mode, the developing device actuator 321 is moved more forwards, and the shaft of the black developing roller 65K also rides on the inclined surface of the recess portion 321B, so that all the developing rollers 65K, 65C, 65M, 65Y are spaced from the photosensitive drums 63K, 63C, 63M, 63Y. That is, the separation mode is set. In the separation mode, the moveable gear 242 is configured to disconnect the gear train of the second developing driving transmission mechanism 240 by the operation of the link 325 and the control device 10 is configured to turn off the electromagnetic clutch 328, so that all the developing cartridges 62 are stopped. Also, upon the switching to the separation mode, the control device 10 is configured to stop the second motor 210 and to stop all the photosensitive drums 63 and the conveyance belt 73.

In the meantime, the switching from the separation mode to the monochrome mode and the color mode can be implemented by the opposite control to the above control.

Subsequently, the control on the conveyance of the sheet S and the separation and stopping of the developing device in the color printer 1 configured as described above is described. The control is executed by the control device 10. The control device 10 is a device configured to control the image forming unit 4, the re-conveyance rollers 95 and the developing device separation/stop mechanism 320, and is configured to form an image on the first surface of the sheet S by the image forming unit 4 and then to switch the developing unit to the separation mode while conveying the sheet S with the re-conveyance rollers 95. Also, the control device 10 is configured to execute respective controls to be described later, in correspondence to various conveyance patterns.

<First Aspect of Conveyance Pattern>

A first aspect of a conveyance pattern is an aspect of conveying the sheet S so that when performing a duplex printing, the printing is consecutively performed on the first surface and second surface of each sheet S and then the sheet S is discharged to the sheet discharge tray 22. That is, in the first aspect, the control device 10 is configured to perform the image formation in order of a first surface of a first recording sheet, a second surface of the first recording sheet and a first surface of a second recording sheet.

The corresponding conveyance pattern is described with reference to FIG. 4. In the meantime, the reference numerals such as 1F, 1B, 2F and the like denoted in FIGS. 4, 7, 8 and 12 are indicators for specifying printing surfaces. In the reference numerals, a number indicates what number the sheet S is, F indicates that an image is formed on the first surface, and B indicates that an image is formed on the second surface.

Figure 4A:
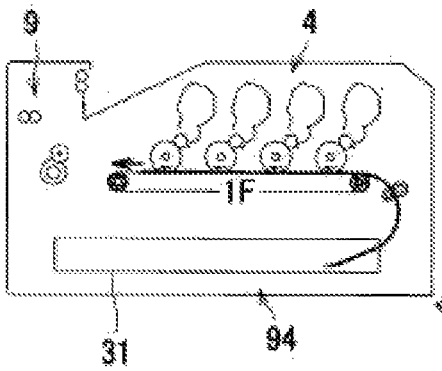
FIGS. 4A to 4F illustrate conveying operations in a first aspect of a conveyance pattern.
Figure 4B:
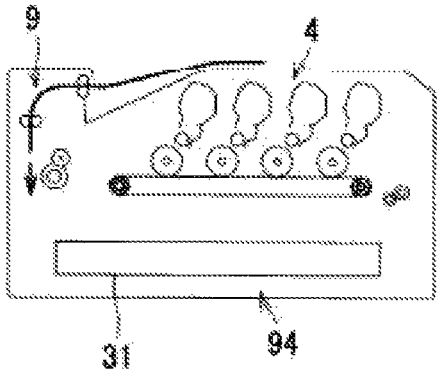
Figure 4C:
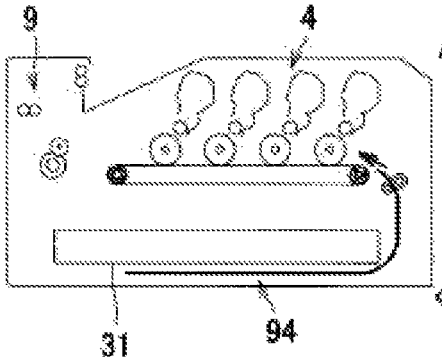
Figure 4D:
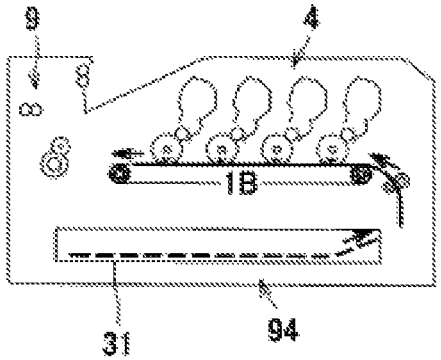
Figure 4E:
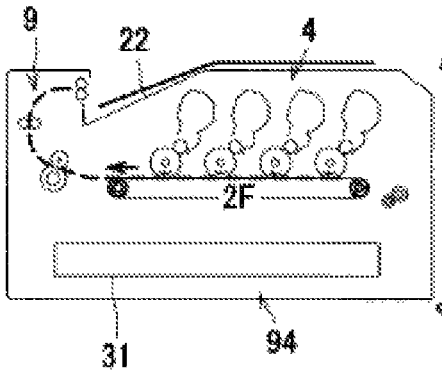
Figure 4F:
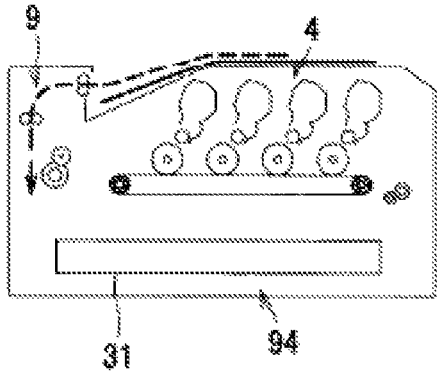

As shown in FIG. 4A, the control device 10 first feeds a first sheet S (first recording sheet) to the image forming unit 4 and forms an image on a first surface (1F) of the first sheet. Then, as shown in FIG. 4B, the control device 10 discharges the first sheet S from the image forming unit 4 and switches back the same by the conveyance unit 9, thereby sending the first sheet to the re-conveyance path 94, as shown in FIG. 4C. Further, as shown in FIG. 4D, the control device 10 sends a second surface (1B) of the first sheet S to the image forming unit 4, forms an image thereon, and feeds a second sheet S (second recording sheet) shown with the broken line from the sheet feeding tray 31, subsequently to the first sheet S. Then, as shown in FIG. 4E, the control device 10 discharges the first sheet S having the image formed on the second surface to the sheet discharge tray 22, forms an image on a first surface (2F) of the second sheet S and then sends the same to the conveyance unit 9. Then, as shown in FIG. 2F, the control device 10 switches back the second sheet S by the conveyance unit 9, and performs the re-conveyance, the image formation of the second surface and the sheet discharge in accordance with the processes of FIG. 4B and thereafter, as described above as regards the first sheet.

In the first aspect, the color printer 1 can implement a configuration of executing a printing speed priority mode in which a printing speed has priority, and a configuration of executing a lifetime priority mode in which it is an object to prolong a lifetime of the developing cartridge 62 as long as possible. In the below, the two operation modes are respective described.

[Printing Speed Priority Mode in First Aspect]

Figure 5:
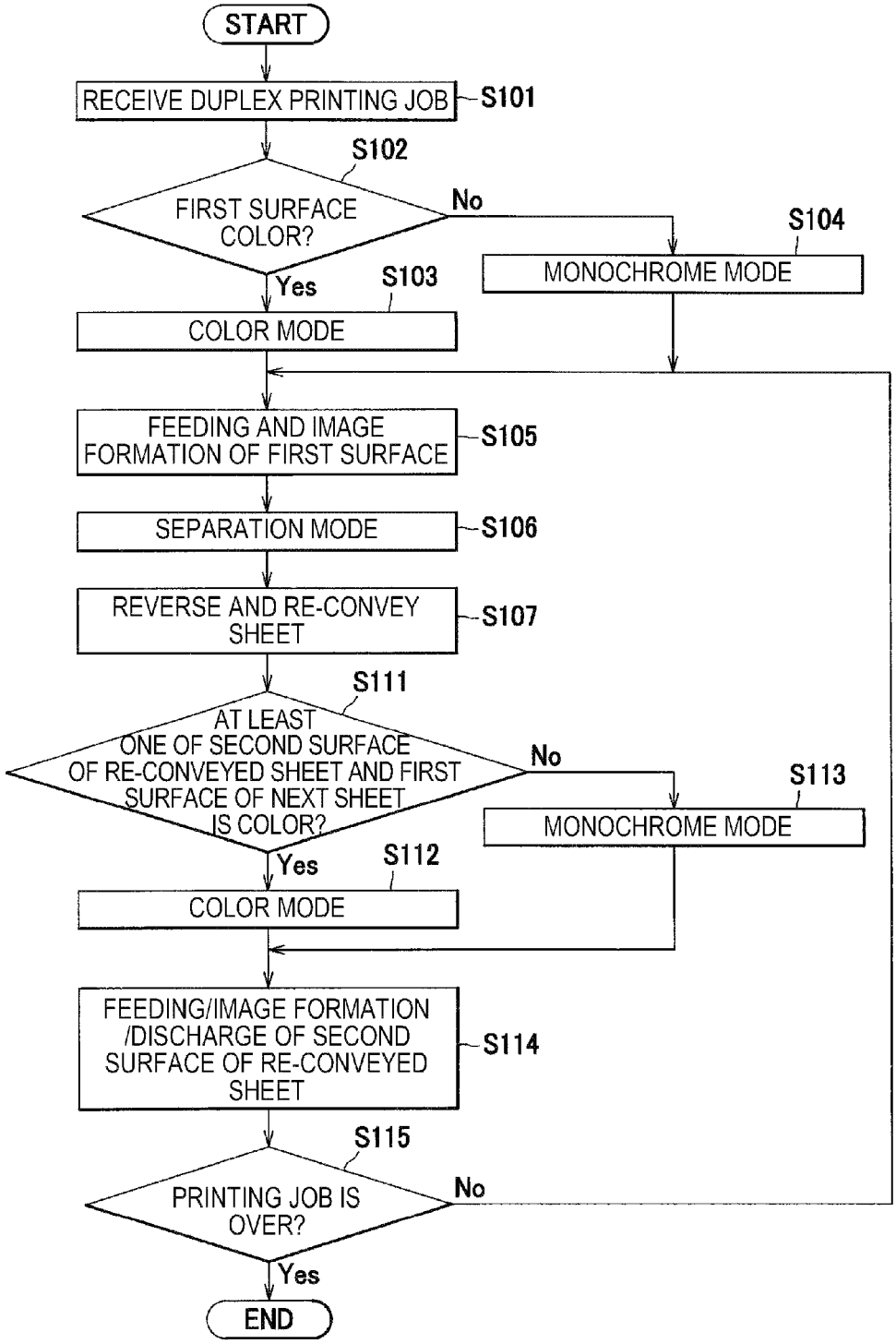
FIG. 5 is a flowchart showing control of a printing speed priority mode in the first aspect.

In case of configuring the color printer 1 with the printing speed priority mode, the control device 10 is configured to execute processing as shown in FIG. 5. In a flowchart of FIG. 5 and the like, since processing that is executed when a printing job is over is not a characteristic part, the detailed description thereof is omitted, and operations that are executed while the duplex printing is continuously performed after the printing starts are described.

As shown in FIG. 5, when a printing job of a duplex printing is received (S101), the control device 10 first determines whether an image to be printed on a first surface is a color image (S102). When the image is a color image (multi-color image) (S102, Yes), the control device 10 controls the developing device separation/stop mechanism 320 to bring all the developing cartridges 62 into contact with the photosensitive drums 63, thereby setting the color mode (S103). When the image is a monochrome image (single-color image) (S102, No), the control device 10 controls the developing device separation/stop mechanism 320 to bring only the black developing cartridge 62K into contact with the photosensitive drum 63K, thereby setting the monochrome mode (S104). Meanwhile, in the below respective illustrative embodiments, the control device 10 is configured to determine the color mode and the monochrome mode just before forming an image, so as to easily understand the illustrative embodiments. However, actually, the corresponding determination may be made to schedule the conveying timings before forming an image after the control device 10 receives the printing job.

Subsequently, the control device 10 feeds the first surface of the first sheet to the image forming unit 4 to form an image thereon (S105, refer to FIG. 4A). Then, the control device 10 separates all the developing cartridges 62 from the photosensitive drums 63 at timing after a rear end of the first sheet S passes through the black photosensitive drum 63K positioned at the most downstream side before it enters the fixing device 8, and turns off the electromagnetic clutch 328, thereby setting the separation mode (S106, refer to FIG. 4B). Meanwhile, in the first aspect, when setting the separation mode, the control device 10 is configured to stop the second motor 210, thereby stopping all the photosensitive drums 63 and the conveyance belt 73, too. Also, in the below, the descriptions about the changes in the operations of the developing cartridges 62, the photosensitive drums 63 and the conveyance belt 73, which are performed when the color mode, the monochrome mode and the separation mode are set, are omitted.

Subsequently, the control device 10 reverses the first sheet S by the conveyance unit 9 and sends and re-conveys the same to the re-conveyance path 94 (S107, refer to FIGS. 4B and 4C). After that, since the control device 10 continues to form images on a second surface of the first sheet S and a first surface of a second sheet S without switching the mode between the color mode and the monochrome mode, thereby implementing the fast printing speed, the control device 10 determines whether the image to be formed on at least one of the second surface of the re-conveyed sheet (first sheet) and the first surface of the next fed sheet (second sheet) is a color image (S111). When at least one image is a color image (S111, Yes), the control device 10 sets the color mode (S112), and when both images are monochrome images (S111, No), the control device 10 sets the monochrome mode (S113). Then, the control device 10 feeds a second surface of the re-conveyed sheet to the image forming unit 4, forms thereon an image designated in the printing job and discharges the sheet to the sheet discharge tray 22 (S114, refer to FIGS. 4C to 4E).

Here, when the printing job is over (S115, Yes), the control device 10 ends the processing. On the other hand, when the printing job is not over (S115, No), the control device 10 returns to step S105 and repeats the processing. For example, the control device 10 feeds a first surface of the second sheet to the image forming unit 4 and forms an image designated in the printing job on the first surface in step S105 (refer to FIG. 4E). In the meantime, the image formations on the second surface of the first sheet and the first surface of the second sheet are continuously performed.

Figure 7:
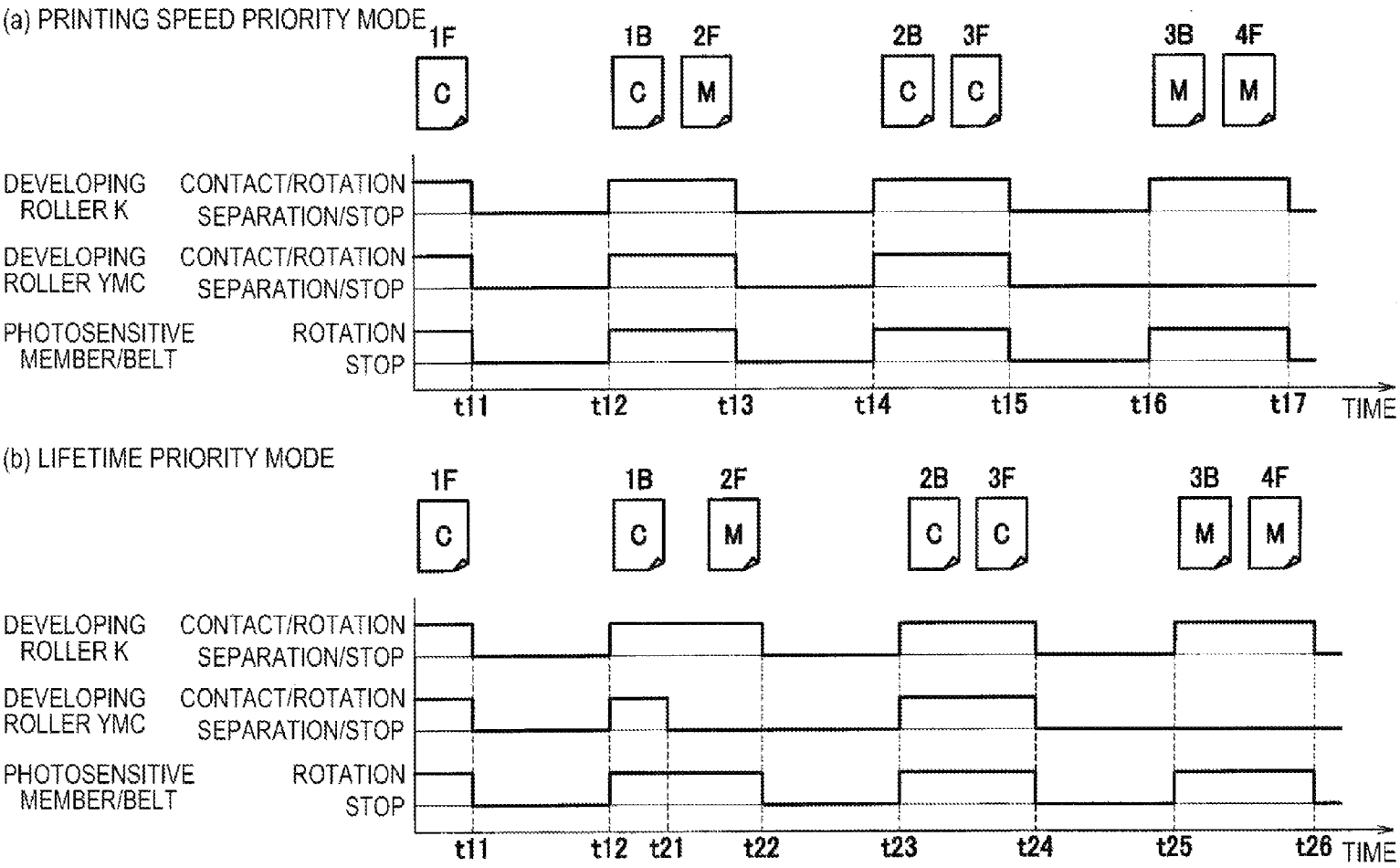
Figure 12:
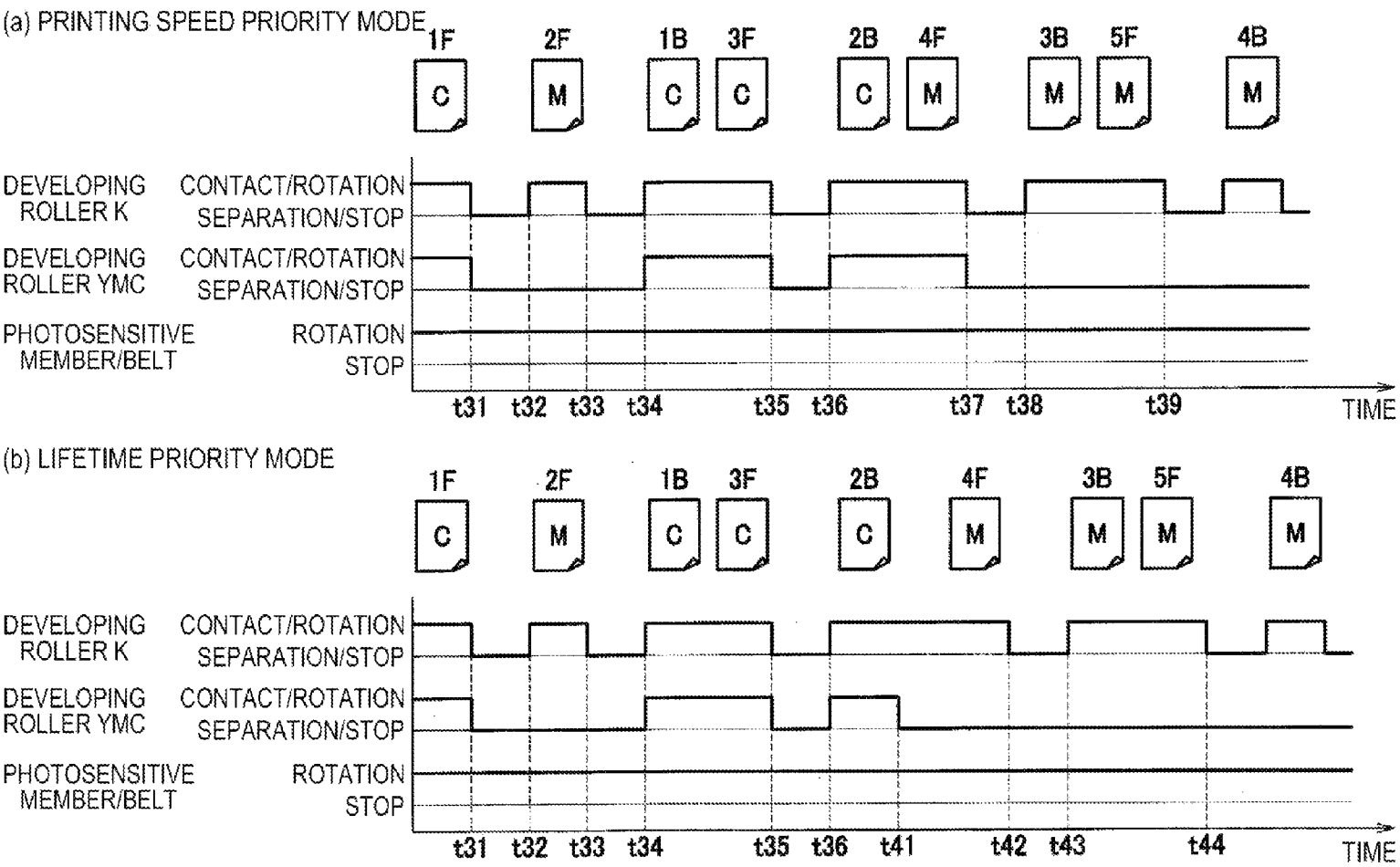

The operations of the respective units in the printing speed priority mode are described with reference to FIG. 7A. In FIGS. 7 and 12, a square indicated above a timing chart means the sheet S that is fed to the image forming unit 4 at corresponding timing, 'C' in the sheet S means that an image to be formed is a color image, and 'M' in the sheet S means that an image to be formed is a monochrome image.

As shown in FIG. 7A, during a time period t11 to t12 after the image formation on the first surface of the first sheet is over (here, at the time that the sheet passes through the black photosensitive drum 63K, not the fixing device 8; the same will apply hereinafter) until the image formation on the second surface of the first sheet starts, since it is not necessary to move the developing cartridges 62, the separation mode is set. Thereby, during a time period for which it is not necessary to move the developing cartridges 62, the developing cartridges 62 are stopped, so that it is possible to prolong the lifetimes of the developing cartridges 62. Also during time periods t13 to t14 and t15 to t16, the developing cartridges 62 are stopped while the sheet S is conveyed with the re-conveyance rollers 95. Therefore, it is possible to prolong the lifetimes of the developing cartridges 62. Since one image to be formed on the printing surfaces 1B, 2F is a color image, the color mode is set during a time period t12 to t13 for which the two surfaces are printed. Thereby, while a monochrome image is printed on the printing surface 2F, the developing cartridges 62C, 62M, 62Y except for the black developing cartridge 62K are operating even though they are not used. This is against the lifetime but can increase the printing speed.

Likewise, during a time t14 to t15, since images to be formed on both the printing surfaces 2B, 3F are color images, the color mode is set. On the other hand, during a time period t16 to t17, since image to be formed on the printing surfaces 3B, 4F are monochrome images, the monochrome mode is set, the developing cartridges 62C, 62M, 62Y except for the black developing cartridge 62K are stopped and the lifetimes thereof can be thus prolonged.

[Lifetime Priority Mode in First Aspect]

Figure 6:
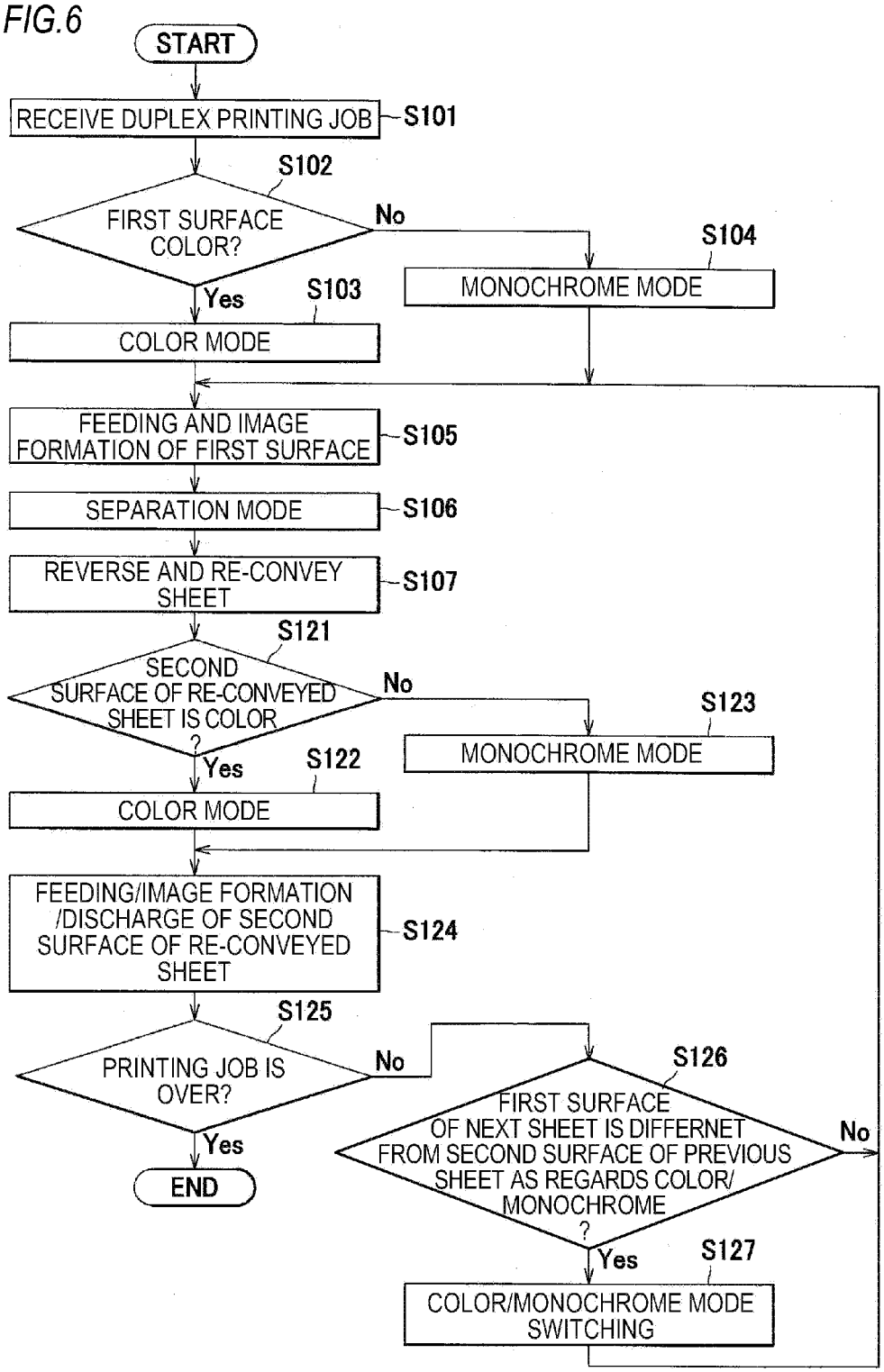
FIG. 6 is a flowchart showing control of a lifetime priority mode in the first aspect.

In case of configuring the color printer 1 with the lifetime priority mode, the control device 10 is configured to execute processing as shown in FIG. 6. In a flowchart of FIG. 6, since the processing up to step S107 is the same as FIG. 5, only step S121 and thereafter are here described.

As shown in FIG. 6, after reversing and re-conveying the sheet S in step S107, the control device 10 determines whether an image to be formed on the second surface of the re-conveyed sheet is a color image. When a result of the determination is positive (S121, Yes), the control device 10 sets the color mode (S122), and when a result of the determination is negative (S121, No), the control device 10 sets the monochrome mode (S123). Then, the control device 10 feeds the second surface of the re-conveyed sheet to the image forming unit 4, forms an image designated in the printing job and discharges the sheet to the sheet discharge tray 22 (S124, refer to FIGS. 4C to 4E).

After that, when the printing job is over (S125, Yes), the control device 10 ends the processing. However, when the printing job is not over (S125, No), the control device 10 determines whether an image to be formed on a first surface of a next sheet S (second sheet) is different from the image formed on the second surface of the previous sheet S (first sheet) as regards a type of color and monochrome. Here, when the type of color and monochrome is different (S126, Yes), the control device 10 switches the mode between the color mode and the monochrome mode (S127), returns to step S105 and repeats the processing. When the type is not different (S126, No), the control device 10 returns to step S105 and repeats the processing, without switching the mode.

The operations of the respective units in the lifetime priority mode are described with reference to FIG. 7B. In FIG. 7B, the color and monochrome patterns of the printing surfaces are the same as FIG. 7A, for comparison with the printing speed priority mode. As shown in FIG. 7B, also in the lifetime priority mode, during the time period t11 to t12 after the image formation on the first surface of the first sheet is over until the image formation on the second surface of the first sheet starts, since it is not necessary to move the developing cartridges 62, the separation mode is set. Thereby, during the time period for which it is not necessary to move the developing cartridges 62, the developing cartridges 62 are stopped, so that it is possible to prolong the lifetimes of the developing cartridges 62.

While an image to be formed on the printing surface 1B is a color image, an image to be formed on the printing surface 2F is a monochrome image. Therefore, the control device 10 forms a color image on the printing surface 1B, switches the mode from the color mode to the monochrome mode at time t21 and then performs a printing on the printing surface 2F. Due to the switching operation, time t22 at which the image formation on the printing surface 2F is over is slightly delayed, as compared to time t13 at which the image formation on the printing surface 2F in the printing speed priority mode is over. Like this, in the lifetime priority mode, the printing speed is slightly delayed, as compared to the printing speed priority mode. However, since the developing cartridges 62C, 62M, 62Y except for the black developing cartridge 62K are spaced from the photosensitive drums 63C, 63M, 63Y and the operations thereof are stopped during the image formation on the printing surface 2F, it is possible to further prolong the lifetimes of the developing cartridges 62C, 62M, 62Y.

After time t22, since images to be continuously formed on the printing surfaces 2B, 3F are all color images, the color mode is set during a time period t23 to t24, and since images to be formed on the printing surfaces 3B, 4F are all monochrome images, the monochrome mode is set during a time period t25 to t26.

<Second Aspect of Conveyance Pattern>

A second aspect of a conveyance pattern is an aspect of conveying the sheet S so that when performing a duplex printing, one or two other sheets S are conveyed to the image forming unit 4 to form images thereon while forming images on first and second surfaces of one sheet S. That is, in the second aspect, the control device 10 is configured to perform image formation in order of a first surface of a first recording sheet, a first or second surface of at least one third recording sheet, a second surface of the first recording sheet and a first surface of the second recording sheet.

Figure 8A:
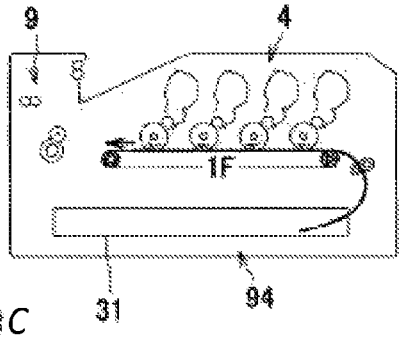
FIGS. 8A to 8H illustrate conveying operations in a second aspect of a conveyance pattern.
Figure 8B:
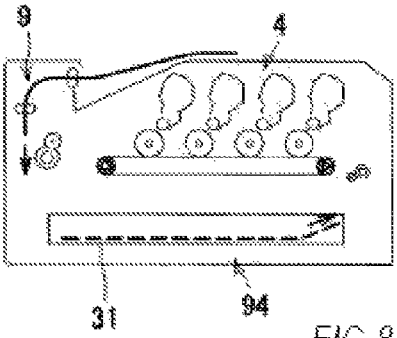
Figure 8C:
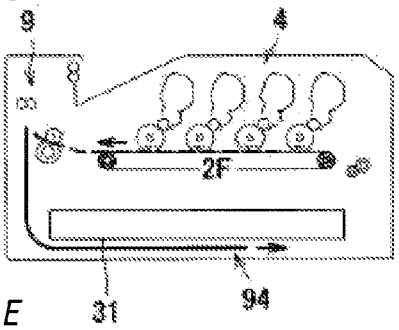

The corresponding conveyance pattern is described with reference to FIG. 8. As shown in FIG. 8A, the control device 10 first feeds one sheet S (first recording sheet) to the image forming unit 4 and forms an image on a first surface (1F) of the first sheet. Then, as shown in FIGS. 8B and 8C, after discharging the first sheet S from the image forming unit 4, the control device 10 feeds a second sheet S (third recording sheet) shown with the broken line to the image forming unit 4 and forms an image on a first surface (2F). At this time, the control device 10 cannot convey the two sheets at the same time in the conveyance unit 9 and can convey one sheet S only in the forward or reverse direction. Therefore, the control device 10 feeds a second sheet S at timing at which the second sheet S is conveyed the conveyance rollers 92 just after the first sheet S facing towards the re-conveyance path 94 passes through the conveyance rollers 92.

Figure 8D:
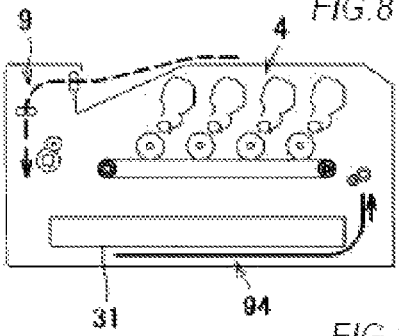
Figure 8E:
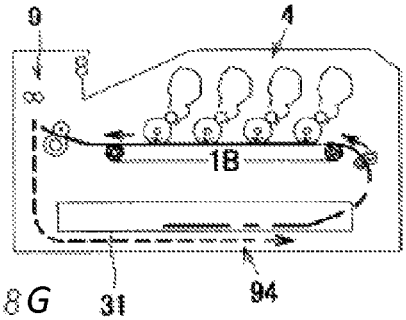

Then, as shown in FIG. 8D, the control device 10 switches back the second sheet S, starts to convey the same towards the re-conveyance path 94, and feeds the second surface of the first sheet S towards the image forming unit 4. After that, as shown in FIG. 8E, the control device 10 conveys the second sheet S to the re-conveyance path 94, forms an image on a second surface (1B) of the first sheet, and feeds a first surface of a third sheet S (second recording sheet) shown with the dashed-dotted line towards the image forming unit 4, subsequently to the first sheet. At this time, the control device 10 feeds the first sheet S at timing at which the first sheet S is conveyed to the conveyance rollers 92 just after the second sheet S facing towards the re-conveyance path 94 passes through the conveyance rollers 92.

Figure 8F:
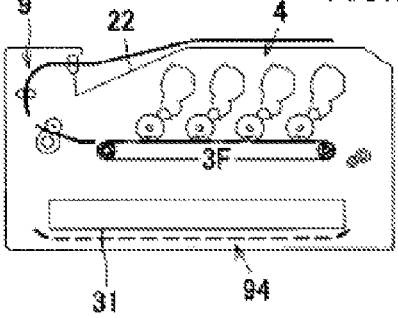
Figure 8G:
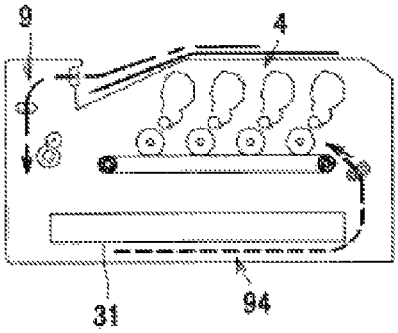
Figure 8H:
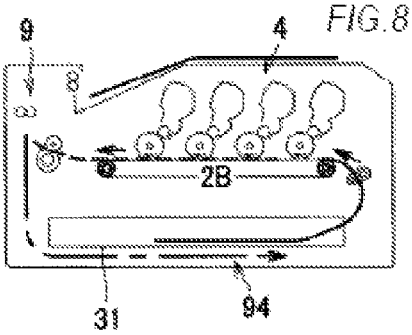

Then, as shown in FIG. 8F, the control device 10 discharges the first sheet S to the sheet discharge tray 22 and forms an image on the first surface (3F) of the third sheet. Then, as shown in FIGS. 8G and 8H, the control device 10 conveys the third sheet S to the conveyance unit 9, switches back and conveys the same to the re-conveyance path 94, and forms an image on a second surface (2B) of the second sheet. Thereafter, the control device 10 performs the image formation on a first surface of a fourth sheet and a second surface of the third sheet and the sheet discharge in accordance with the processes of FIG. 8E and thereafter, as described above as regards the first sheet.

As can be seen from the above descriptions, the image formation is performed for the one second sheet (third recording sheet) between the image formations of the first and second surfaces of the first sheet S. In the meantime, when regarding the second sheet S as the first recording sheet, since the image formation is performed for the second surface of the first sheet and the first surface of the third sheet between the image formations of the first and second surfaces of the second sheet, the image formation is performed for the two third recording sheets.

In this second aspect, the color printer 1 can implement the configuration of executing the printing speed priority mode in which the printing speed has priority, and the configuration of executing the lifetime priority mode in which it is an object to prolong a lifetime of the developing cartridge 62 as long as possible. In the below, the two operation modes are respective described.

[Printing Speed Priority Mode in Second Aspect]

Figure 9:
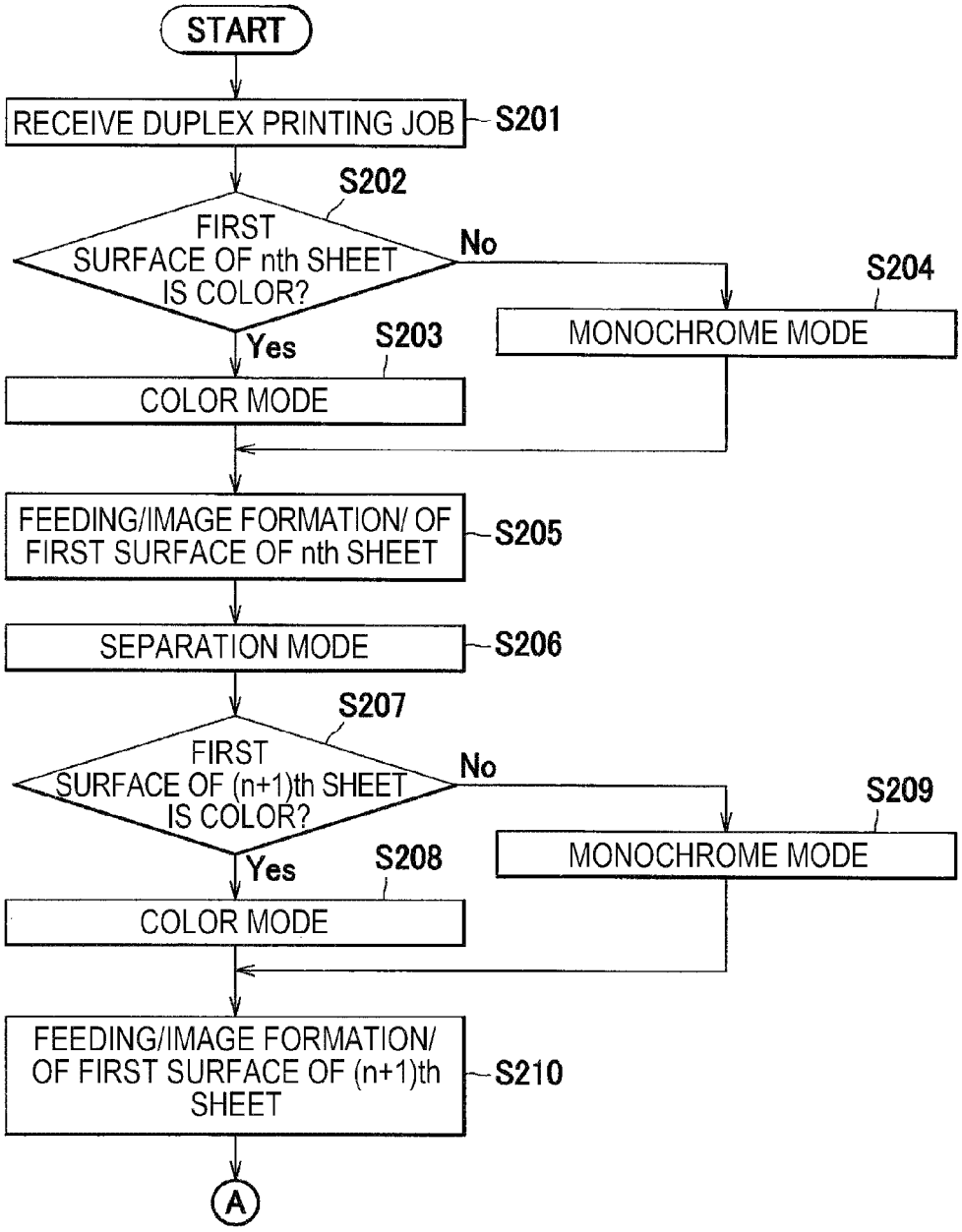
FIG. 9 is a flowchart showing a first half of control in the second aspect.
Figure 10:
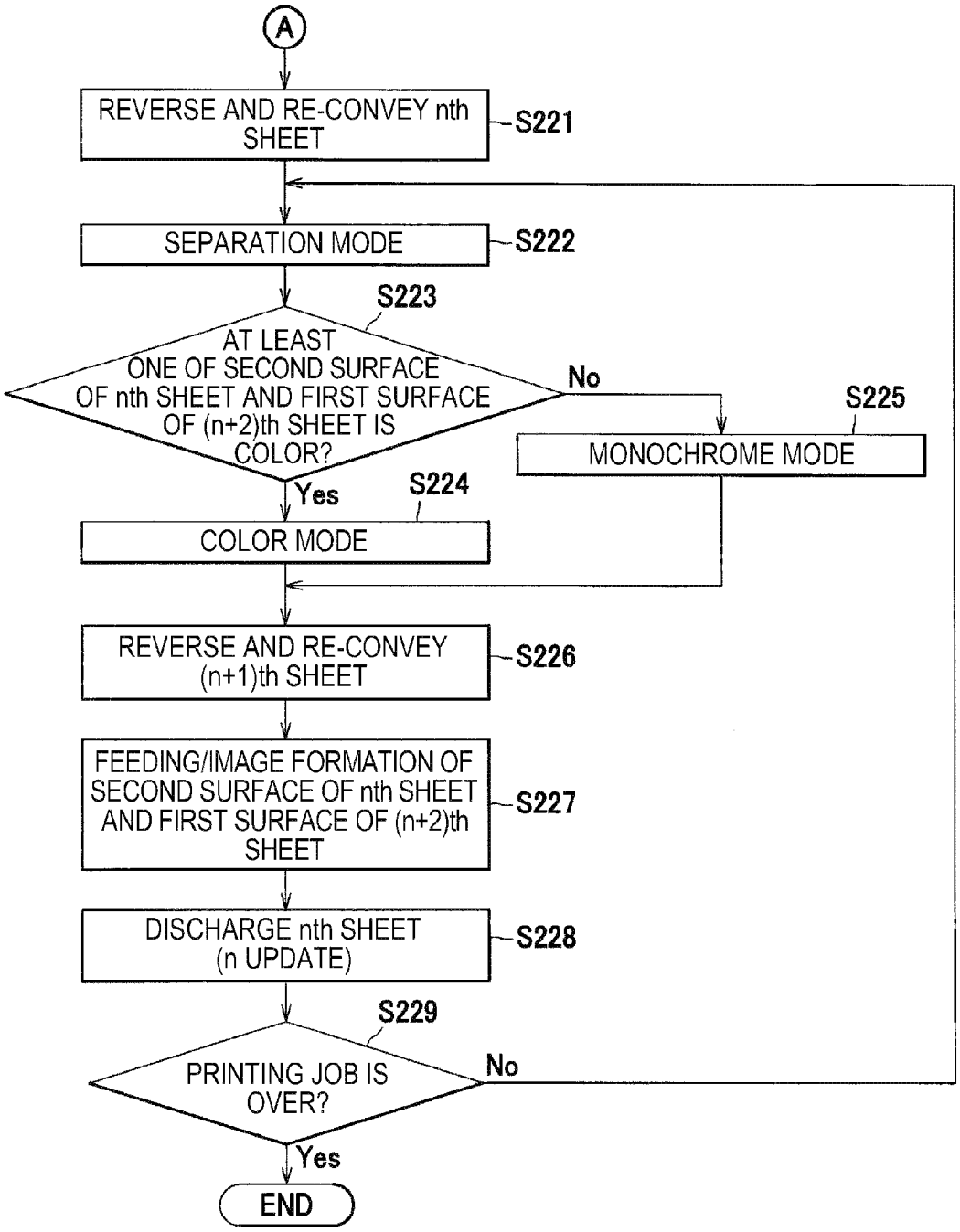
FIG. 10 is a flowchart showing the control of the printing speed priority mode in the second aspect, subsequently to FIG. 9.

In case of configuring the color printer 1 with the printing speed priority mode, the control device 10 is configured to execute processing as shown in FIGS. 9 and 10. As shown in FIG. 9, when a printing job of a duplex printing is received (S201), the control device 10 first determines whether an image to be printed on a first surface of an $n^{th}$ sheet is a color image (S202). When the image is a color image (S202, Yes), the control device 10 set the color mode (S203), and when the image is a monochrome image (S202, No), the control device 10 sets the monochrome mode (S204). Subsequently, the control device 10 feeds the first surface of the $n^{th}$ sheet to the image forming unit 4 to form an image thereon (S205, refer to FIG. 8A). Then, the control device 10 sets the separation mode at timing after a rear end of the $n^{th}$ sheet S passes through the black photosensitive drum 63K positioned at the most downstream side before it enters the fixing device 8 (S206, refer to FIG. 8B). Meanwhile, in the second aspect, since the printing speed is high, the second motor 210 is not stopped in the separation mode, so that the photosensitive drums 63 and the belt 73 are still moved, unlike the first aspect. That is, while executing the printing job, the photosensitive drums 63 and the belt 73 are still moved.

Subsequently, the control device 10 determines whether an image to be formed on a first surface of a $(n+1)^{th}$ sheet is a color image (S207). When the image is a color image (S207, Yes), the control device 10 sets the color mode (S208), and when the image is a monochrome image (S207, No), the control device 10 sets the monochrome mode (S209). Then, the control device 10 feeds the first surface of the $(n+1)^{th}$ sheet to the image forming unit 4 and forms thereon an image (S210, refer to FIG. 8C).

Then, as shown in FIG. 10, the control device 10 reverses the $n^{th}$ sheet S by the conveyance unit 9, sends and re-conveys the same to the re-conveyance path 94 (S221, refer to FIGS. 8B and 8C). Then, the control device 10 sets the separation mode at timing after a rear end of the $(n+1)^{th}$ sheet passes through the black photosensitive drum 63K before it enters the fixing device 8 (S222, refer to FIG. 8D).

Thereafter, since the control device 10 continues to form images on a second surface of the $n^{th}$ sheet and a first surface of a $(n+2)^{th}$ sheet without switching the mode between the color mode and the monochrome mode, thereby implementing the high printing speed, the control device 10 determines whether the image to be formed on at least one of the second surface of the $n^{th}$ sheet S and the first surface of the $(n+2)^{th}$ sheet is a color image (S223). When at least one image is a color image (S223, Yes), the control device 10 sets the color mode (S224), and when both images are monochrome images (S223, No), the control device 10 sets the monochrome mode (S225). Then, the control device 10 switches back the $(n+1)^{th}$ sheet by the conveyance unit 9, sends the same to the re-conveyance path 94 (S226), feeds the second surface of the $n^{th}$ sheet and the first surface of the $(n+2)^{th}$ sheet to the image forming unit 4 in corresponding order, forms thereon images designated in the printing job (S227, refer to FIGS. 8E and 8F) and discharges the $n^{th}$ sheet to the sheet discharge tray 22 (S228, refer to FIG. 8F).

Then, when the printing job is over (S229, Yes), the control device 10 ends the processing. On the other hand, when the printing job is not over (S229, No), the control device 10 returns to step S222 and repeats the processing. In the meantime, 'n update' in step S228 means that when returning to step S222 and executing the processing, the sheet S, which was the $(n+1)^{th}$ sheet in the processing of previous step S223, is treated as the $n^{th}$ sheet in the processing of this time step S223.

The operations of the respective units in the printing speed priority mode are described with reference to FIG. 12A. As shown in FIG. 12A, during a time period t31 to t32 after the image formation on the first surface of the first sheet is over until the image formation on the second surface of the second sheet starts, since it is not necessary to move the developing cartridges 62, the separation mode is set. Thereby, during a time period for which it is not necessary to move the developing cartridges 62, the developing cartridges 62 are stopped, so that it is possible to prolong the lifetimes of the developing cartridges 62. Also during time periods t33 to t34, t35 to t36 and t37 to t38 for which the sheet S is re-conveyed with the re-conveyance rollers 95, the developing cartridges 62 are stopped. Therefore, it is possible to prolong the lifetimes of the developing cartridges 62.

Since at least one image to be formed on the printing surfaces 1B, 3F, 2B, 4F is a color image, the color mode is set during time periods t34 to t35, t36 to t37 for which the two surfaces are printed, respectively. Thereby, while a monochrome image is formed on the printing surface 4F, the developing cartridges 62C, 62M, 62Y except for the black developing cartridge 62K are operating even though they are not used. This is against the lifetime but can increase the printing speed because a sheet interval between the sheets S being conveyed can be minimized.

On the other hand, during a time t38 to t39, since images to be formed on both the printing surfaces 3B, 5F are monochrome images, the monochrome mode is set, the developing cartridges 62C, 62M, 62Y except for the black developing cartridge 62K are stopped and the lifetimes thereof can be thus prolonged.

[Lifetime Priority Mode in Second Aspect]

Figure 11:
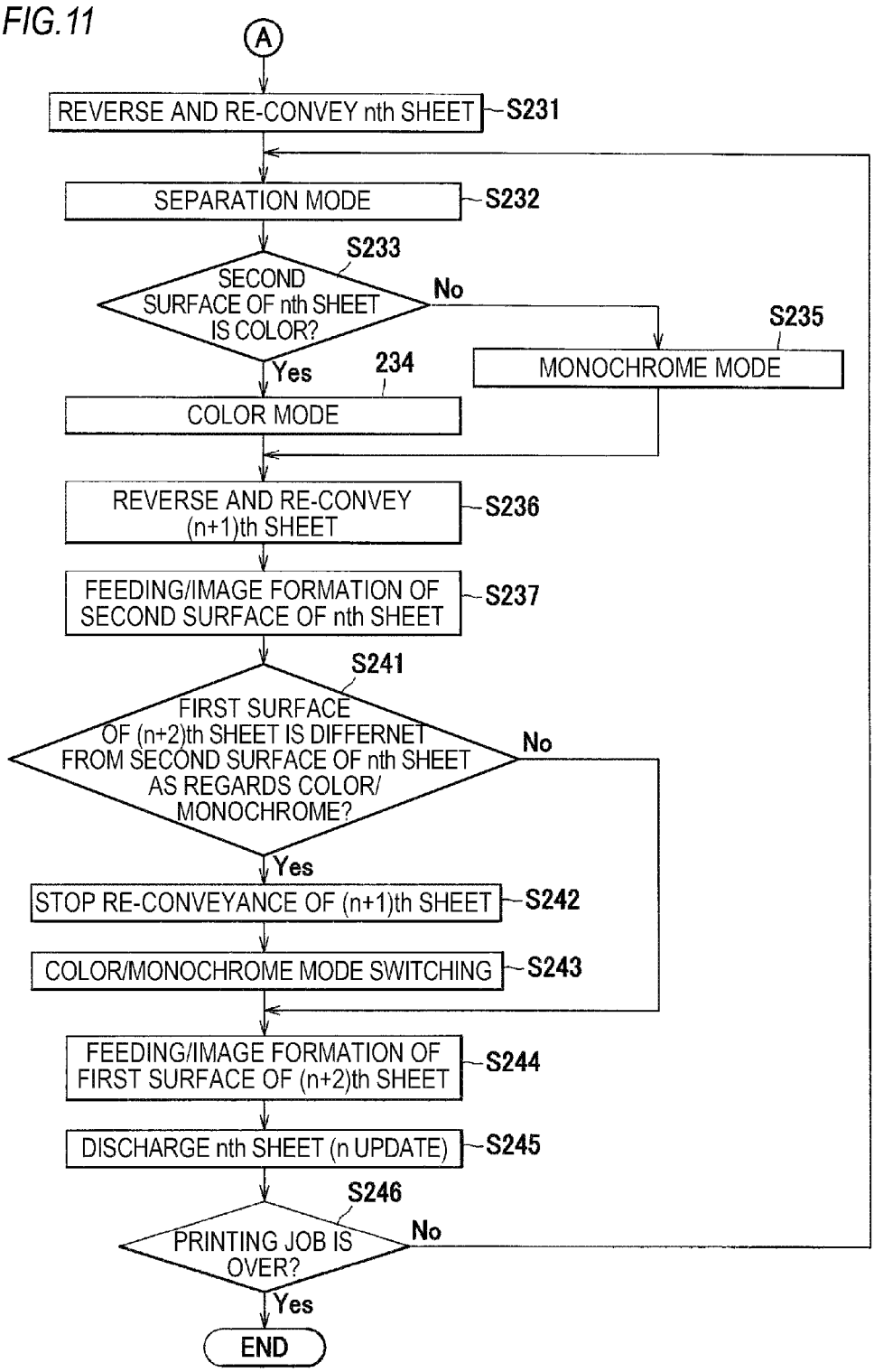
FIG. 11 is a flowchart showing the control of the lifetime priority mode in the second aspect, subsequently to FIG. 9.

In case of configuring the color printer 1 with the lifetime priority mode, the control device 10 is configured to execute processing as shown in FIGS. 9 and 11. Since the processing of FIG. 9 has been described, only step S121 and thereafter of FIG. 11 are here described.

As shown in FIG. 11, the control device 10 reverses and re-conveys the $n^{th}$ sheet S (S231). Then, the control device 10 sets the separation mode at timing after a rear end of the $(n+1)^{th}$ sheet S passes through the black photosensitive drum 63K positioned at the most downstream side before it enters the fixing device 8 (S232). Then, the control device 10 determines whether an image to be formed on the second surface of the $n^{th}$ sheet is a color image (S233). When a result of the determination is positive (S233, Yes), the control device 10 sets the color mode (S234), and when a result of the determination is negative (S233, No), the control device 10 sets the monochrome mode (S235). Then, the control device 10 switches back the $(n+1)^{th}$ sheet by the conveyance unit 9, sends the same to the re-conveyance path 94 (S236), feeds the second surface of the $n^{th}$ sheet to the image forming unit 4 and forms thereon an image designated in the printing job (S237, refer to FIG. 8E).

Then, the control device 10 determines whether an image to be formed on a first surface of a $(n+2)^{th}$ sheet is different from the image formed on the second surface of the $n^{th}$ sheet as regards a type of color and monochrome. Here, when the type of color and monochrome is different (S241, Yes), the control device 10 controls the moveable gear 162 to temporarily stop the re-conveyance rollers 95 (S242) and switches the mode between the color mode and the monochrome mode during the stop (S243). On the other hand, when the type is not different (S241, No), the control device 10 proceeds to step S244, without switching the mode.

Then, the control device 10 drives the re-conveyance rollers 95 to feed the first surface of the $(n+2)^{th}$ sheet to the image forming unit 4, forms thereon an image (S244) and discharges the $n^{th}$ sheet S to the sheet discharge tray 22 (S245). Thereafter, when the printing job is over (S246, Yes), the control device 10 ends the processing. On the other hand, when the printing job is not over (S246, No), the control device 10 returns to step S232 and repeats the processing.

The operations of the respective units in the lifetime priority mode are described with reference to FIG. 12B. In FIG. 12B, the color and monochrome patterns of the printing surfaces are the same as FIG. 12A, for comparison with the printing speed priority mode. As shown in FIG. 12B, also in the lifetime priority mode, during the time period t31 to t32 after the image formation on the first surface of the first sheet is over until the image formation on the second surface of the second sheet starts, since it is not necessary to move the developing cartridges 62, the separation mode is set. Thereby, during the time period for which it is not necessary to move the developing cartridges 62, the developing cartridges 62 are stopped, so that it is possible to prolong the lifetimes of the developing cartridges 62. This is also the same for time periods t33 to t34, t35 to t36 and t42 to t43.

Since images to be formed on the printing surfaces 1B, 3F are all color images, the color mode is set during a time period t34 to t35 for which the two surfaces are printed. Also, since images to be formed on the printing surfaces 3B, 5F are all monochrome images, the monochrome mode is set during a time period t43 to t44 for which the two surfaces are printed. Thereby, when printing the two surfaces, since the images are continuously formed with the minimum sheet interval, it is possible to form the images at the high printing speed.

However, while an image to be formed on the printing surface 2B is a color image, an image to be formed on the printing surface 4F is a monochrome image. Therefore, the control device 10 forms a color image on the printing surface 2B, switches the mode from the color mode to the monochrome mode at time t41 and then performs a printing on the printing surface 4F. Due to the switching operation, time t42 at which the image formation on the printing surface 4F is over is slightly delayed, as compared to time t37 at which the image formation on the printing surface 4F in the printing speed priority mode is over. Like this, in the lifetime priority mode, the printing speed is slightly delayed, as compared to the printing speed priority mode. However, since the developing cartridges 62C, 62M, 62Y except for the black developing cartridge 62K are spaced from the photosensitive drums 63C, 63M, 63Y and the operations thereof are stopped during the image formation on the printing surface 4F, it is possible to further prolong the lifetimes of the developing cartridges 62C, 62M, 62Y.

Modified Embodiments

Although the illustrative embodiment of the present disclosure has been described, the present disclosure is not limited to the above illustrative embodiment and can be appropriately modified and implemented.

For example, in the second aspect of the conveyance pattern of the above illustrative embodiment, the sheets may be conveyed so that the images are formed on first surfaces of a second sheet and a third sheet between the first and second surfaces of the first sheet. That is, the sheets may be conveyed so that the image formation is performed in order of 1F→2F→3F→1B→4F→2B→5F→3B . . . .

Also, the image forming apparatus is not limited to the printer, and may be a copier or complex machine.

In the above illustrative embodiment, the sheet has been exemplified as the recording sheet. However, an OHP sheet or cloth may also be adopted.

In the second aspect of the above illustrative embodiment, the two third recording sheets are formed with the images between the first and second surfaces of the second sheet S. However, three or more recording sheets may be formed with images.

Also, the configuration of the gear for conveying the recording sheet and the various actuators are just exemplary and are not particularly limited to the above inasmuch as the recording sheet can be conveyed and the developing device can be separated from the photosensitive drum at appropriate timing, for example.

According to the above configuration, it is possible to rapidly form the images because it is not necessary to switch the multi-color mode and the single color mode between the image formation of the first image and the image formation of the second image.

According to the above configuration, when it is possible to form the first image and the second image with the same mode, the multi-color mode and the single color mode are not switched between the image formation of the first image and the image formation of the second image, so that it is possible to rapidly form the images. On the other hand, when the first image and the second image are formed with the different modes, a multi-color image is formed with the multi-color mode and a single color image is formed with the single color mode. Thus, while forming the single color image, it is possible to separate and stop a second developing device from the second photosensitive member, so that it is possible to prolong the lifetime of the second developing device.

According to the present disclosure, while conveying the first recording sheet by the re-conveyance mechanism, the developing unit is set to the separation mode, so that the first developing device is spaced and stopped from the first photosensitive member and the second developing device is spaced and stopped from the second photosensitive member. Therefore, it is possible to prolong the lifetimes of the first developing device and the second developing device.

What is claimed is:

1. An image forming apparatus comprising:

a photosensitive member;

a rotatable developer carrier;

a transfer member configured to transfer a developer image on a recording sheet at a transfer position;

a feeder mechanism defining a sheet feeding path for feeding the recording sheet to the transfer position, the feeder mechanism including a supply roller arranged on the sheet feeding path;

a re-conveyance mechanism defining a re-conveyance path for re-conveying the recording sheet having passed through the transfer position to the transfer position again, the re-conveyance mechanism including a re-conveyance roller arranged on the re-conveyance path;

an actuator configured to separate the developer carrier from the photosensitive member, and a control device configured to drive the actuator in a direction in which the developer carrier is separated from the photosensitive member, stop rotation of the developer carrier and stop rotation of the photosensitive member while the re-conveyance roller conveys the recording sheet.

2. The image forming apparatus according to claim 1 further comprising:

a housing configured to accommodate the photosensitive member and the developer carrier;

a discharge tray provided at an outer side of the housing and configured to support the recording sheet discharged to an outside of the housing; and a switchback roller configured to rotate in a forward direction to convey the recording sheet having passed through the transfer position in a direction coming close to the discharge tray and configured to rotate in a reverse direction opposite to the forward direction, wherein the control device is configured to drive the actuator after a rotating direction of the switchback roller is switched from the forward direction to the reverse direction.

3. The image forming apparatus according to claim 2, wherein the control device is configured to drive the actuator in a direction in which the developer carrier is separated from the photosensitive member after the rotating direction of the switchback roller is switched from the forward direction to the reverse direction.

4. The image forming apparatus according to claim 1, wherein the control device is configured to stop rotation of the photosensitive member while the re-conveyance roller conveys the recording sheet.

5. The image forming apparatus according to claim 1, wherein the transfer member includes a rotatable belt, and the control device is configured to stop rotation of the belt while the re-conveyance roller conveys the recording sheet.

6. The image forming apparatus according to claim 1, wherein the control device is configured to stop rotation of the re-conveyance roller while the control device drives the actuator.

7. The image forming apparatus according to claim 1, wherein one end of the re-conveyance path is connected to one end of the sheet feeding path.

8. The image forming apparatus according to claim 2, wherein the housing includes the discharge tray.

9. An image forming apparatus comprising:

a photosensitive member;

a rotatable developer carrier;

a transfer member configured to transfer a developer image on a recording sheet at a transfer position;

a feeder mechanism defining a sheet feeding path for feeding the recording sheet to the transfer position, the feeder mechanism including a supply roller arranged on the sheet feeding path;

a re-conveyance mechanism defining a re-conveyance path for re-conveying the recording sheet having passed through the transfer position to the transfer position again, the re-conveyance mechanism including a re-conveyance roller arranged on the re-conveyance path;

an actuator configured to separate the developer carrier from the photosensitive member, and a control device configured to drive the actuator in a direction in which the developer carrier is separated from the photosensitive member and stop rotation of the developer carrier while the re-conveyance roller conveys the recording sheet, wherein the transfer member includes a rotatable belt, and wherein the control device is configured to stop rotation of the belt while the re-conveyance roller conveys the recording sheet.

10. The image forming apparatus according to claim 9 further comprising:

a housing configured to accommodate the photosensitive member and the developer carrier;

a discharge tray provided at an outer side of the housing and configured to support the recording sheet discharged to an outside of the housing; and a switchback roller configured to rotate in a forward direction to convey the recording sheet having passed through the transfer position in a direction coming close to the discharge tray and configured to rotate in a reverse direction opposite to the forward direction, wherein the control device is configured to drive the actuator after a rotating direction of the switchback roller is switched from the forward direction to the reverse direction.

11. The image forming apparatus according to claim 10, wherein the control device is configured to drive the actuator in a direction in which the developer carrier is separated from the photosensitive member after the rotating direction of the switchback roller is switched from the forward direction to the reverse direction.

12. The image forming apparatus according to claim 11, wherein the control device is configured to stop rotation of the photosensitive member while the re-conveyance roller conveys the recording sheet.

13. The image forming apparatus according to claim 11, wherein the transfer member includes a rotatable belt, and the control device is configured to stop rotation of the belt while the re-conveyance roller conveys the recording sheet.

14. The image forming apparatus according to claim 9, wherein the control device is configured to stop rotation of the re-conveyance roller while the control device drives the actuator.

15. The image forming apparatus according to claim 9, wherein one end of the re-conveyance path is connected to one end of the sheet feeding path.

16. The image forming apparatus according to claim 10, wherein the housing includes the discharge tray.

17. An image forming apparatus comprising:

a photosensitive member;

a rotatable developer carrier;

a transfer member configured to transfer a developer image on a recording sheet at a transfer position;

a feeder mechanism defining a sheet feeding path for feeding the recording sheet to the transfer position, the feeder mechanism including a supply roller arranged on the sheet feeding path;

a re-conveyance mechanism defining a re-conveyance path for re-conveying the recording sheet having passed through the transfer position to the transfer position again, the re-conveyance mechanism including a re-conveyance roller arranged on the re-conveyance path;

an actuator configured to separate the developer carrier from the photosensitive member, and a control device configured to drive the actuator while the re-conveyance roller conveys the recording sheet, wherein the control device is configured to stop rotation of the re-conveyance roller while the control device drives the actuator.

18. The image forming apparatus according to claim 17, wherein the control device is configured to drive the actuator in a direction in which the developer carrier is separated from the photosensitive member while the re-conveyance roller conveys the recording sheet.

19. The image forming apparatus according to claim 18, wherein the control device is configured to stop rotation of the developer carrier while the re-conveyance roller conveys the recording sheet.

20. The image forming apparatus according to claim 19 further comprising:

a housing configured to accommodate the photosensitive member and the developer carrier;

a discharge tray provided at an outer side of the housing and configured to support the recording sheet discharged to an outside of the housing; and a switchback roller configured to rotate in a forward direction to convey the recording sheet having passed through the transfer position in a direction coming close to the discharge tray and configured to rotate in a reverse direction opposite to the forward direction, wherein the control device is configured to drive the actuator after a rotating direction of the switchback roller is switched from the forward direction to the reverse direction.

21. The image forming apparatus according to claim 18, wherein one end of the re-conveyance path is connected to one end of the sheet feeding path.

22. The image forming apparatus according to claim 20, wherein the housing includes the discharge tray.

* * * * *